US012529377B2

(12) United States Patent
Yamamoto et al.

(10) Patent No.: US 12,529,377 B2
(45) Date of Patent: Jan. 20, 2026

(54) SCROLL COMPRESSOR

(71) Applicant: KABUSHIKI KAISHA TOYOTA JIDOSHOKKI, Kariya (JP)

(72) Inventors: Shiori Yamamoto, Kariya (JP); Takuro Yamashita, Kariya (JP); Ken Namiki, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 91 days.

(21) Appl. No.: 18/485,820

(22) Filed: Oct. 12, 2023

(65) Prior Publication Data

US 2024/0133379 A1 Apr. 25, 2024
US 2024/0229793 A9 Jul. 11, 2024

(30) Foreign Application Priority Data

Oct. 21, 2022 (JP) ..... 2022-169348

(51) Int. Cl.
*F04C 18/02* (2006.01)

(52) U.S. Cl.
CPC ..... *F04C 18/0215* (2013.01); *F04C 18/0207* (2013.01); *F04C 18/0246* (2013.01); *F04C 18/0261* (2013.01)

(58) Field of Classification Search
CPC ..... F04C 18/0215; F04C 18/0261; F04C 18/0207; F04C 18/0246
See application file for complete search history.

(56) References Cited

U.S. PATENT DOCUMENTS 5,649,817 A * 7/1997 Yamazaki ..... F04C 18/0269 418/55.1
6,000,917 A * 12/1999 Smerud ..... F04C 29/023 417/366
6,769,881 B2 * 8/2004 Lee ..... F04C 28/28 417/310
7,223,083 B2 * 5/2007 Kim ..... F04C 18/0215 418/60
7,381,037 B2 * 6/2008 Kim ..... F04C 18/0215 417/410.5

(Continued)

FOREIGN PATENT DOCUMENTS

JP 2001-522969 A 11/2001
JP 2005-264752 A 9/2005

(Continued)

*Primary Examiner* — Christopher S Bobish
(74) *Attorney, Agent, or Firm* — Sughrue Mion, PLLC

(57) ABSTRACT

A scroll compressor includes a compression chamber that compresses a fluid, an outer peripheral passage into which the fluid flows from a motor chamber, and a suction passage draws in the fluid from the outer peripheral passage to the compression chamber. The compression chamber is defined by a fixed scroll and an orbiting scroll. The outer peripheral passage is defined by a third peripheral wall of a discharge housing member and a fixed peripheral wall of the fixed scroll. The suction passage is provided in the fixed peripheral wall and includes an upstream-side outer peripheral surface located between the suction passage and an electric motor in an axial direction of a rotary shaft. A distance from an axis of the rotary shaft to the upstream-side outer peripheral surface varies in the axial direction of the rotary shaft.

5 Claims, 3 Drawing Sheets

(56) References Cited

U.S. PATENT DOCUMENTS

| | | | | |
|---|---|---|---|---|
| 7,497,674 | B2 * | 3/2009 | Tateishi | F04C 18/0276 418/55.3 |
| 8,678,796 | B2 * | 3/2014 | Kimata | F04C 18/0276 418/55.4 |
| 9,121,276 | B2 * | 9/2015 | Heidecker | F04C 27/008 |
| 9,651,047 | B2 * | 5/2017 | Yamashita | F04C 29/12 |
| 9,689,386 | B2 * | 6/2017 | Fraser | F04C 18/0215 |
| 9,719,511 | B2 * | 8/2017 | Imai | F04C 27/005 |
| 9,732,752 | B2 * | 8/2017 | Jin | F04C 18/0246 |
| 9,816,499 | B2 * | 11/2017 | Ishikawa | F04B 35/04 |
| 9,951,772 | B2 * | 4/2018 | Duppert | F04C 18/0215 |
| 11,168,688 | B2 * | 11/2021 | Koike | F04C 23/008 |
| 11,286,930 | B2 * | 3/2022 | Yamashita | F04C 29/0021 |
| 11,619,228 | B2 * | 4/2023 | Kingseed | F04C 18/0215 418/55.1 |
| 2006/0222545 | A1 * | 10/2006 | Nam | F04C 18/0253 418/55.1 |
| 2014/0023542 | A1 * | 1/2014 | Yamashita | F04C 18/0215 418/55.6 |
| 2019/0301461 | A1 * | 10/2019 | Yamashita | F04C 18/0261 |
| 2020/0347846 | A1 | 11/2020 | Imanishi et al. | |
| 2021/0301820 | A1 | 9/2021 | Fukaya | |

FOREIGN PATENT DOCUMENTS

| | | | |
|---|---|---|---|
| JP | 2021-46805 | A | 3/2021 |
| JP | 2021-161947 | A | 10/2021 |
| KR | 10-2019-0114838 | A | 10/2019 |
| WO | 2019/155516 | A1 | 8/2019 |

* cited by examiner

SCROLL COMPRESSOR

BACKGROUND

1. Field

The present disclosure relates to a scroll compressor.

2. Description of Related Art

Japanese Laid-Open Patent Publication No. 2021-161947 discloses a scroll compressor that includes a rotary shaft, an electric motor, a housing, a fixed scroll, and an orbiting scroll. The electric motor rotates the rotary shaft. The housing includes a motor chamber that accommodates the electric motor. The fixed scroll is accommodated in and fixed to the housing. The fixed scroll includes a fixed end wall and a tubular peripheral wall extending from the fixed end wall toward the orbiting scroll. The orbiting scroll orbits as the rotary shaft rotates.

The scroll compressor includes a compression chamber, an outer peripheral passage, and a suction passage. The compression chamber is defined by the fixed scroll and the orbiting scroll. The compression chamber compresses a fluid. The outer peripheral passage is defined by an inner peripheral surface of the housing and an outer peripheral surface of the peripheral wall of the fixed scroll. The fluid flows into the outer peripheral passage from the motor chamber. The suction passage is provided in the peripheral wall. The suction passage draws fluid into the compression chambers from the outer peripheral passage.

The flow of fluid through the outer peripheral passage is limited when the distance from the inner peripheral surface of the housing to the outer peripheral surface of the peripheral wall of the fixed scroll is small, that is, when the outer peripheral passage is narrow. As a method of expanding the outer peripheral passage, for example, the following two methods may be used. The first method is a method of increasing the size of the housing outward as disclosed in Japanese Laid-Open Patent Publication No. 2021-161947. The second method is a method of reducing the thickness of the peripheral wall of the fixed scroll. However, the first method increases the size of the compressor. The second method may fail to ensure the strength of the fixed scroll.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a scroll compressor includes a rotary shaft, an electric motor that rotates the rotary shaft, a housing including a motor chamber that accommodates the electric motor, a fixed scroll accommodated in the housing and fixed to the housing, and an orbiting scroll that orbits as the rotary shaft rotates. The fixed scroll includes a fixed end wall and a tubular peripheral wall that extends from the fixed end wall toward the orbiting scroll. The scroll compressor further includes a compression chamber, an outer peripheral passage, and a suction passage. The compression chamber is defined by the fixed scroll and the orbiting scroll. The compression chamber compresses fluid. The outer peripheral passage is defined by an inner peripheral surface of the housing and an outer peripheral surface of the peripheral wall. Fluid flows into the outer peripheral passage from the motor chamber. The suction passage is provided in the peripheral wall. The suction passage draws in the fluid from the outer peripheral passage to the compression chamber. The outer peripheral surface of the peripheral wall includes an upstream-side outer peripheral surface located between the suction passage and the electric motor in an axial direction of the rotary shaft. A distance from an axis of the rotary shaft to the upstream-side outer peripheral surface in a direction orthogonal to the axial direction of the rotary shaft varies in the axial direction of the rotary shaft.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, except for operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

A scroll compressor 10 according to one embodiment will now be described with reference to FIGS. 1 to 4. The scroll compressor 10 of the present embodiment is used in a vehicle air conditioner.

Figure 1:
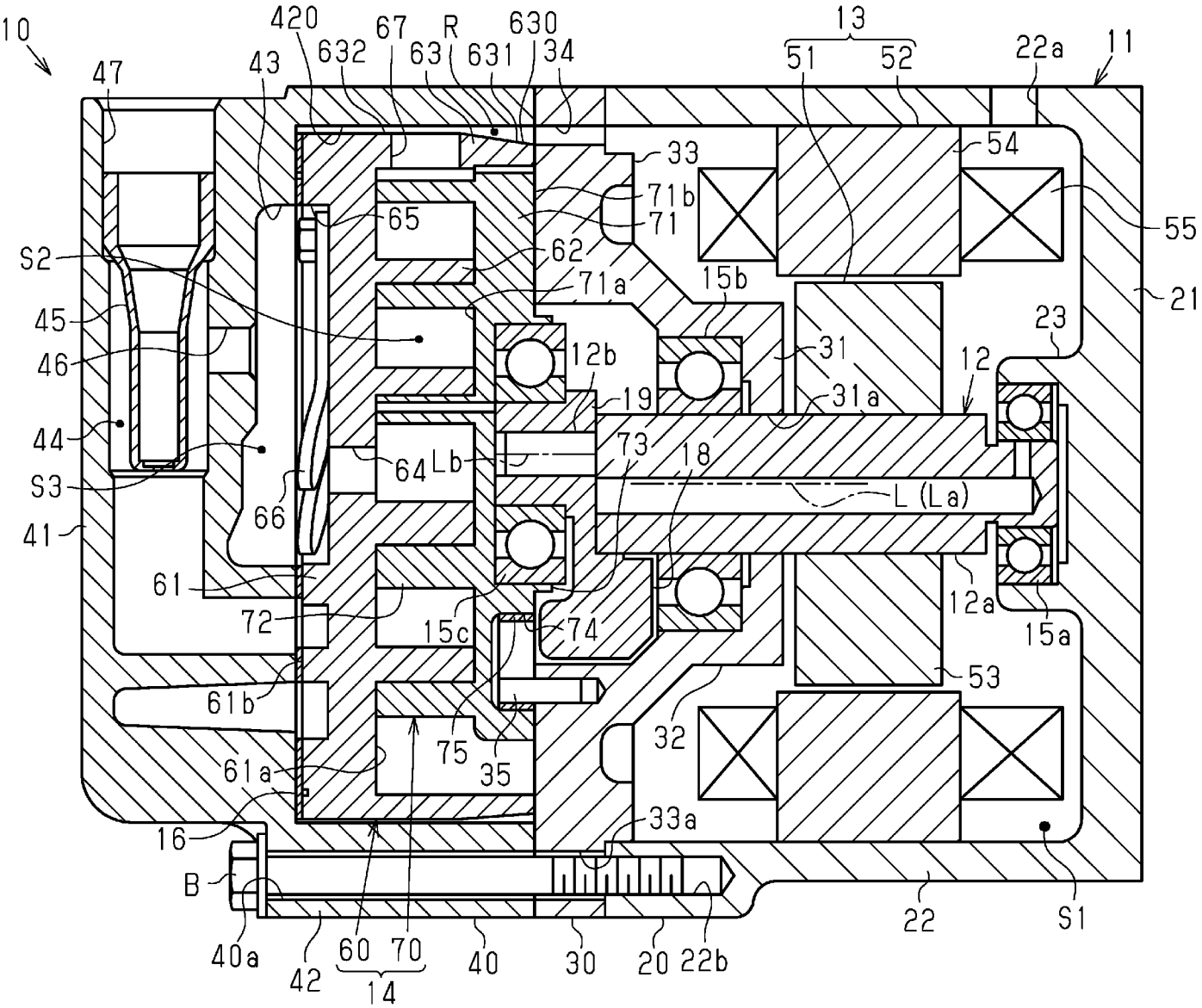
FIG. 1 is a cross-sectional view showing a scroll compressor according to an embodiment.

As shown in FIG. 1, the scroll compressor 10 includes a housing 11, a rotary shaft 12, an electric motor 13, and a compression mechanism 14. The housing 11 accommodates the rotary shaft 12, the electric motor 13, and the compression mechanism 14. The electric motor 13 rotates the rotary shaft 12. The compression mechanism 14 is driven by rotation of the rotary shaft 12.

Housing

The housing 11 includes a motor housing member 20, a shaft support housing member 30, and a discharge housing member 40. The housing 11 is made of metal. The housing 11 of the present embodiment is made of aluminum.

The motor housing member 20 has a tubular shape with a closed end and includes a first bottom wall 21 and a tubular first peripheral wall 22, which extends from the outer periphery of the first bottom wall 21. The motor housing member 20 includes a cylindrical first boss 23. The first boss 23 protrudes from an inner surface of the first bottom wall 21. The motor housing member 20 includes an suction port 22*a*. The suction port 22*a* is formed in a part of the first peripheral wall 22 that is near the first bottom wall 21. The suction port 22*a* connects the interior and the exterior of the motor housing member 20 to each other. The motor housing member 20 includes internal thread holes 22*b*. FIG. 1 shows only one of the internal thread holes 22*b*. The internal thread holes 22*b* are formed in a distal end face of the first peripheral wall 22. The internal thread holes 22*b* are spaced apart from each other in the circumferential direction of the first peripheral wall 22.

The shaft support housing member 30 has a tubular shape with a closed end and includes a second bottom wall 31 and a tubular second peripheral wall 32, which extends from the outer periphery of the second bottom wall 31. The shaft support housing member 30 includes a circular shaft insertion hole 31*a*. The shaft insertion hole 31*a* is formed at the center of the second bottom wall 31. The shaft insertion hole 31*a* extends through the second bottom wall 31 in the thickness direction.

The shaft support housing member 30 includes a circular and annular flange 33. The flange 33 extends outward in the radial direction of the second peripheral wall 32 from an end of the second peripheral wall 32 that is on a side opposite to the second bottom wall 31.

The shaft support housing member 30 includes first bolt insertion holes 33*a* and connecting holes 34. FIG. 1 shows only one of the first bolt insertion holes 33*a* and one of the connecting holes 34. The first bolt insertion holes 33*a* and the connecting holes 34 are formed in the outer periphery of the flange 33. The first bolt insertion holes 33*a* and the connecting holes 34 extend through the flange 33 in the thickness direction. The first bolt insertion holes 33*a* are spaced apart from each other in the circumferential direction of the flange 33. The connecting holes 34 are formed at positions different from the positions of the first bolt insertion holes 33*a* in the circumferential direction of the flange 33.

The shaft support housing member 30 includes pins 35. FIG. 1 shows only one of the pins 35. The pins 35 protrude from the flange 33 toward the side opposite to the second bottom wall 31. The pins 35 are located inward of the first bolt insertion holes 33*a* and the connecting holes 34 in the radial direction of the flange 33.

The shaft support housing member 30 closes the opening of the motor housing member 20. The distal end face of the first peripheral wall 22 of the motor housing member 20 is in contact with the flange 33 of the shaft support housing member 30. The axial direction of the second peripheral wall 32 of the shaft support housing member 30 agrees with the axial direction of the first peripheral wall 22 of the motor housing member 20.

The motor housing member 20 and the shaft support housing member 30 define a motor chamber S1. The electric motor 13 is accommodated in the motor chamber S1. The housing 11 thus includes the motor chamber S1, which accommodates the electric motor 13. Refrigerant, which is fluid, is drawn into the motor chamber S1 from an external refrigerant circuit (not shown) through the suction port 22*a*. Thus, the motor chamber S1 is a suction chamber into which refrigerant is drawn through the suction port 22*a*.

The first bolt insertion holes 33*a* of the shaft support housing member 30 are respectively continuous with the internal thread holes 22*b* of the motor housing member 20. The connecting holes 34 of the shaft support housing member 30 are located on the radially inner side of the inner peripheral surface of the first peripheral wall 22 of the motor housing member 20. The connecting holes 34 are thus connected to the motor chamber S1.

The discharge housing member 40 has a tubular shape with a closed end and includes a third bottom wall 41 and a tubular third peripheral wall 42, which extends from the outer periphery of the third bottom wall 41.

Figure 2:
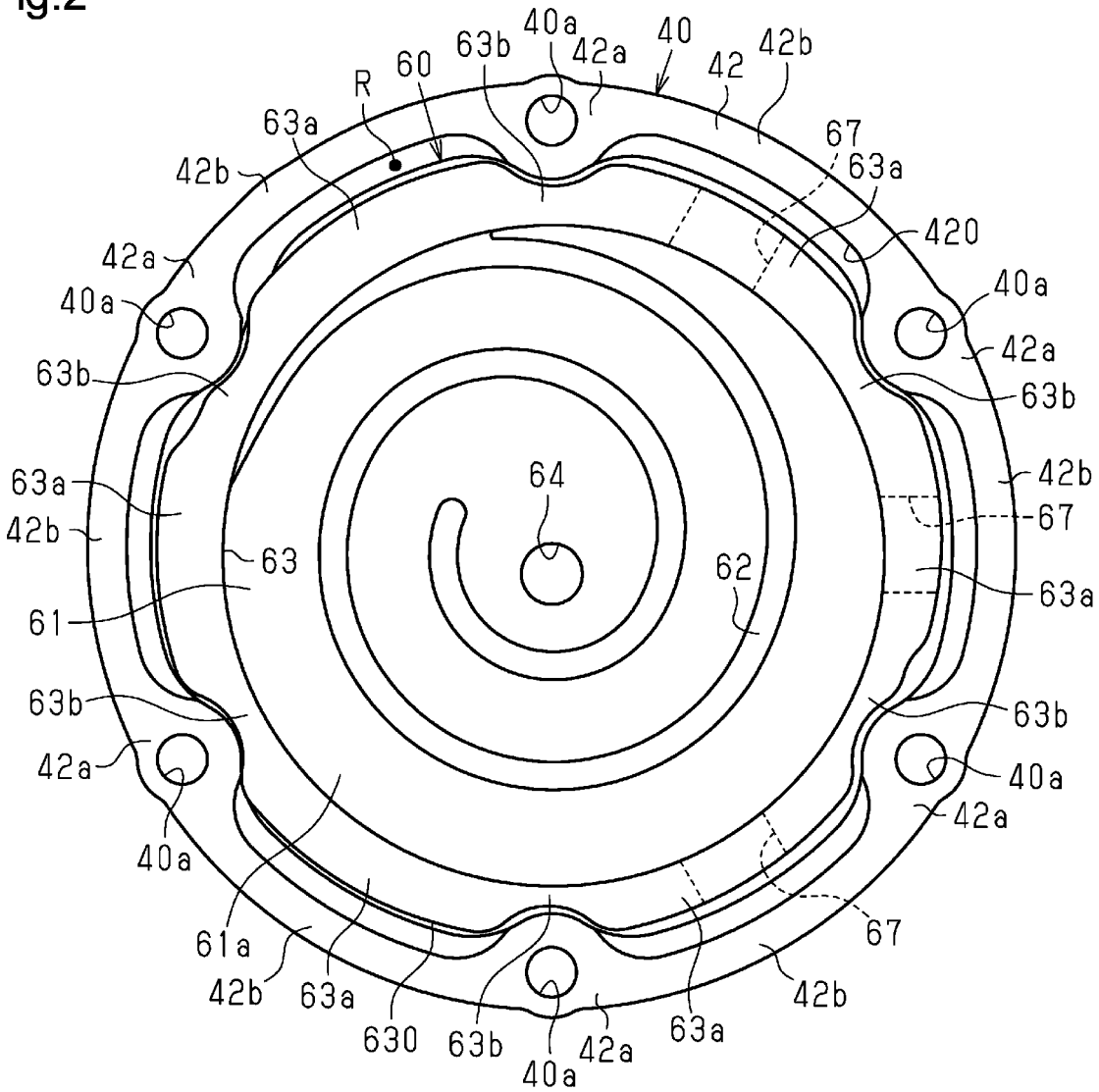
FIG. 2 is a front view showing a discharge housing member and a fixed scroll of the embodiment.

As shown in FIG. 2, the outer diameter of the third peripheral wall 42 is substantially constant over the entire circumference of the third peripheral wall 42. The inner diameter of the third peripheral wall 42 varies in the circumferential direction of the third peripheral wall 42. Therefore, the thickness of the third peripheral wall 42 varies in the circumferential direction of the third peripheral wall 42. The third peripheral wall 42 includes thick portions 42*a* and thin portions 42*b*. The thick portions 42*a* and the thin portions 42*b* are arranged alternately in the circumferential direction of the third peripheral wall 42. An inner peripheral surface 420 of the third peripheral wall 42 bulges further radially inward in each of the thick portions 42*a* than in the thin portions 42*b*.

The discharge housing member 40 includes second bolt insertion holes 40*a*. The second bolt insertion holes 40*a* extend through the discharge housing member 40 in the axial direction of the third peripheral wall 42. The second bolt insertion holes 40*a* are spaced apart from each other in the circumferential direction of the third peripheral wall 42. In the present embodiment, the second bolt insertion holes 40*a* are formed in the thick portions 42*a* of the third peripheral wall 42.

As shown in FIG. 1, the discharge housing member 40 includes a first recess 43. The first recess 43 is recessed from the inner surface of the third bottom wall 41. The discharge housing member 40 includes an oil separation chamber 44. The oil separation chamber 44 is provided in the third bottom wall 41. A cylindrical member 45 is fitted in an inner wall defining the oil separation chamber 44. The discharge housing member 40 includes an inflow passage 46. The inflow passage 46 connects the interior of the first recess 43 and the interior of the oil separation chamber 44 to each other. The discharge housing member 40 includes a discharge port 47. The discharge port 47 connects the interior of the cylindrical member 45 and the exterior of the discharge housing member 40 to each other.

The discharge housing member 40 is arranged on an end face of the shaft support housing member 30 that is on a side opposite to the motor housing member 20. The flange 33 of the shaft support housing member 30 is held between the first peripheral wall 22 of the motor housing member 20 and the third peripheral wall 42 of the discharge housing member 40. The distal end face of the third peripheral wall 42 of the discharge housing member 40 is in contact with the flange 33 of the shaft support housing member 30. The axial direction of the third peripheral wall 42 of the discharge housing member 40 agrees with the axial direction of the second peripheral wall 32 of the shaft support housing member 30. The second bolt insertion holes 40*a* of the discharge housing member 40 are respectively continuous with the first bolt insertion holes 33*a* of the shaft support housing member 30. The connecting holes 34 of the shaft support housing member 30 are located on the radially inner side of the inner peripheral surface 420 of the third peripheral wall 42 of the discharge housing member 40.

The motor housing member 20, the shaft support housing member 30, and the discharge housing member 40 are coupled to one another by bolts B. FIG. 1 shows only one of the bolts B. Specifically, the bolts B are inserted into the second bolt insertion holes 40*a* of the discharge housing member 40 and the first bolt insertion holes 33*a* of the shaft support housing member 30. The external threads of the bolts B are respectively screwed into the internal thread holes 22*b* of the motor housing member 20. The housing 11 is formed by integrating the motor housing member 20, the shaft support housing member 30, and the discharge housing member 40.

Rotary Shaft

The rotary shaft 12 includes a main shaft 12*a* and an eccentric shaft 12*b*. The outer diameter of the main shaft 12*a* is greater than the outer diameter of the eccentric shaft 12*b*.

The main shaft 12*a* is inserted into the shaft insertion hole 31*a* of the shaft support housing member 30. The main shaft 12*a* has a first end, which is inserted into the first boss 23. A first bearing 15*a* is provided between the inner peripheral surface of the first boss 23 and the outer peripheral surface of the first end of the main shaft 12*a*. The first bearing 15*a* is, for example, a rolling-element bearing. The first end of the main shaft 12*a* is rotationally supported by the motor housing member 20 with the first bearing 15*a*. The main shaft 12*a* has a second end on a side opposite to the first end. The second end of the main shaft 12*a* is located on the inner side of the shaft support housing member 30. A second bearing 15*b* is provided between the inner peripheral surface of the second peripheral wall 32 of the shaft support housing member 30 and the outer peripheral surface of the second end of the main shaft 12*a*. The second bearing 15*b* is, for example, a rolling-element bearing. The second end of the main shaft 12*a* is rotationally supported by the shaft support housing member 30 with the second bearing 15*b*.

The eccentric shaft 12*b* protrudes from an end face of the second end of the main shaft 12*a*. The eccentric shaft 12*b* has an axis Lb extending parallel to an axis La of the main shaft 12*a*. The axis Lb of the eccentric shaft 12*b* is located at a position eccentric from the axis La of the main shaft 12*a*.

The axis La of the main shaft 12*a* is hereinafter referred to as an axis L of the rotary shaft 12. The direction in which the axis L of the rotary shaft 12 extends is referred to as an axial direction of the rotary shaft 12. The axial direction of the rotary shaft 12 agrees with the axial direction of the first peripheral wall 22 of the motor housing member 20, the axial direction of the second peripheral wall 32 of the shaft support housing member 30, and the axial direction of the third peripheral wall 42 of the discharge housing member 40.

Electric Motor

The electric motor 13 includes a rotor 51 and a stator 52.

The rotor 51 includes a cylindrical rotor core 53 and permanent magnets (not shown) provided in the rotor core 53. The main shaft 12*a* of the rotary shaft 12 is inserted in the rotor core 53. The rotor core 53 is fixed to the rotary shaft 12. The rotor 51 is integrally rotational with the rotary shaft 12.

The stator 52 is arranged on the radially outer side of the rotor 51. The stator 52 surrounds the rotor 51. The stator 52 includes a cylindrical stator core 54 and a coil 55. The stator core 54 is fixed to the inner peripheral surface of the first peripheral wall 22 of the motor housing member 20. The coil 55 is wound about the stator core 54.

When the coil 55 is supplied with electricity and a rotating magnetic field is generated in the stator 52, the rotor 51 rotates. Accordingly, the rotary shaft 12 rotates integrally with the rotor 51.

Compression Mechanism

The compression mechanism 14 includes a fixed scroll 60 and an orbiting scroll 70.

As shown in FIGS. 1 and 2, the fixed scroll 60 includes a disc-shaped fixed end wall 61, a fixed volute wall 62, and a fixed peripheral wall 63, which is a tubular peripheral wall. The fixed volute wall 62 and the fixed peripheral wall 63 protrude from a first surface 61*a* of the fixed end wall 61. The fixed peripheral wall 63 is located on an outer periphery the fixed end wall 61. The fixed peripheral wall 63 surrounds the fixed volute wall 62.

As shown in FIG. 2, the inner diameter of the fixed peripheral wall 63 is substantially constant over the entire circumference of the fixed peripheral wall 63. The outer diameter of the fixed peripheral wall 63 varies in the circumferential direction of the fixed peripheral wall 63. Accordingly, the thickness of the fixed peripheral wall 63 in the radial direction of the fixed peripheral wall 63 varies in the circumferential direction of the fixed peripheral wall 63. The fixed peripheral wall 63 includes thick portions 63*a* and thin portions 63*b*. The thick portions 63*a* and the thin portions 63*b* are alternately arranged in the circumferential direction of the fixed peripheral wall 63.

The fixed scroll 60 includes a discharge passage 64. The discharge passage 64 is formed at the center of the fixed end wall 61. The discharge passage 64 extends through the fixed end wall 61 in the thickness direction.

As shown in FIG. 1, the fixed scroll 60 includes a second recess 65. The second recess 65 is recessed from a second surface 61*b*, which is on a side opposite to the first surface 61*a* of the fixed end wall 61. The discharge passage 64 opens in the bottom surface of the second recess 65. A valve mechanism 66 is attached to the bottom surface of the second recess 65. The valve mechanism 66 is configured to open and close the discharge passage 64.

As shown in FIGS. 1 and 2, the fixed scroll 60 includes suction passages 67. Each suction passage 67 extends through the fixed peripheral wall 63 in the radial direction. The suction passages 67 connect the interior and the exterior of the fixed peripheral wall 63 to each other. The suction passages 67 are arranged at intervals in the circumferential direction of the fixed peripheral wall 63. In the present embodiment, each suction passage 67 is provided in one of the thick portions 63*a* of the fixed peripheral wall 63. The thick portions 63*a* are thus parts of the fixed peripheral wall 63 that are adjacent to the respective suction passages 67 in the circumferential direction.

As shown in FIG. 1, the orbiting scroll 70 includes a disc-shaped orbiting end wall 71 and an orbiting volute wall 72. The orbiting volute wall 72 protrudes from a first surface 71*a* of the orbiting end wall 71. The orbiting scroll 70 includes a cylindrical second boss 73. The second boss 73 protrudes from a second surface 71*b*, which is on a side opposite to the first surface 71*a* of the orbiting end wall 71. The orbiting scroll 70 includes grooves 74. FIG. 1 shows only one of the grooves 74. The grooves 74 are recessed from the second surface 71*b* of the orbiting end wall 71. The grooves 74 are located outward of the second boss 73 in the radial direction of the orbiting end wall 71. A circular ring member 75 is fitted in each groove 74. The pins 35 of the shaft support housing member 30 are respectively inserted into the ring members 75.

The fixed scroll 60 and the orbiting scroll 70 are arranged such that the first surface 61*a* of the fixed end wall 61 and the first surface 71*a* of the orbiting end wall 71 face each other. The fixed volute wall 62 and the orbiting volute wall 72 mesh with each other. The orbiting volute wall 72 is located on the inner side of the fixed peripheral wall 63. The distal end face of the fixed volute wall 62 is in contact with the first surface 71*a* of the orbiting end wall 71. The distal end face of the orbiting volute wall 72 is in contact with the first surface 61*a* of the fixed end wall 61.

The fixed scroll 60 and the orbiting scroll 70 define compression chambers S2 that compress refrigerant. Specifically, each compression chamber S2 is defined by the first surface 61*a* of the fixed end wall 61, the fixed volute wall 62, the inner peripheral surface of the fixed peripheral wall 63, the first surface 71*a* of the orbiting end wall 71, and the orbiting volute wall 72.

The compression mechanism 14 is accommodated in a space defined by the shaft support housing member 30 and the discharge housing member 40. The fixed scroll 60 is located between the flange 33 of the shaft support housing member 30 and the third bottom wall 41 of the discharge housing member 40. The fixed scroll 60 is fixed to the housing 11 by being held between the flange 33 of the shaft support housing member 30 and the third bottom wall 41 of the discharge housing member 40.

The fixed end wall 61 is located between the third bottom wall 41 of the discharge housing member 40 and the orbiting scroll 70. A gasket 16 is arranged between the second surface 61*b* of the fixed end wall 61 and the inner surface of the third bottom wall 41 of the discharge housing member 40. The gasket 16 provides a seal between the fixed end wall 61 and the third bottom wall 41.

The first recess 43 of the discharge housing member 40 and the second recess 65 of the fixed end wall 61 define a discharge chamber S3. After being compressed in the compression chambers S2, the refrigerant is discharged to the discharge chamber S3 through the discharge passage 64.

The fixed volute wall 62 and the fixed peripheral wall 63 each extend from the first surface 61*a* of the fixed end wall 61 toward the orbiting scroll 70. The axial direction of the fixed peripheral wall 63 agrees with the axial direction of the third peripheral wall 42 of the discharge housing member 40. The distal end face of the fixed peripheral wall 63 is in contact with the flange 33 of the shaft support housing member 30. An outer peripheral surface 630 of the fixed peripheral wall 63 is spaced apart from and faces the inner peripheral surface 420 of the third peripheral wall 42 of the discharge housing member 40.

As shown in FIG. 2, the thick portions 63*a* of the fixed peripheral wall 63 are respectively lined up in the radial direction with the thin portions 42*b* of the third peripheral wall 42. The thin portions 63*b* of the fixed peripheral wall 63 are respectively lined up in the radial direction with the thick portions 42*a* of the third peripheral wall 42.

As shown in FIG. 1, the orbiting scroll 70 is located between the shaft support housing member 30 and the fixed end wall 61 of the fixed scroll 60. The second surface 71*b* of the orbiting end wall 71 faces the flange 33 of the shaft support housing member 30. The orbiting volute wall 72 extends from the first surface 71*a* of the orbiting end wall 71 in a direction away from the electric motor 13.

Balance Weight and Bushing

The scroll compressor 10 includes a balance weight 18 and a bushing 19. The balance weight 18 and the bushing 19 are formed integrally. The balance weight 18 and the bushing 19, together with the compression mechanism 14, are accommodated in a space defined by the shaft support housing member 30 and the discharge housing member 40.

The bushing 19 is fitted to the outer peripheral surface of the eccentric shaft 12*b*. The bushing 19 is inserted into the second boss 73. A third bearing 15*c* is arranged between the inner peripheral surface of the second boss 73 and the outer peripheral surface of the bushing 19. The third bearing 15*c* is, for example, a rolling-element bearing. The orbiting scroll 70 is supported by the eccentric shaft 12*b* with the bushing 19 and the third bearing 15*c* so as to be rotational relative to the eccentric shaft 12*b*. The balance weight 18 is arranged on the inner side of the flange 33 of the shaft support housing member 30.

Rotation of the main shaft 12*a* is transmitted to the orbiting scroll 70 via the eccentric shaft 12*b*, the bushing 19, and the third bearing 15*c*. At this time, the pins 35 are brought into contact with the inner peripheral surfaces of the respective ring members 75, so that the orbiting scroll 70 is prevented from spinning. The orbiting scroll 70 is allowed only to orbit relative to the fixed scroll 60. That is, the orbiting scroll 70 orbits as the rotary shaft 12 rotates. When the orbiting scroll 70 orbits, the orbiting volute wall 72 contacts the fixed volute wall 62 to reduce the volume of each compression chamber S2, so that the refrigerant in the compression chamber S2 is compressed. The balance weight 18 cancels out the centrifugal force acting on the orbiting scroll 70 when the orbiting scroll 70 orbits, thereby reducing the amount of imbalance of the orbiting scroll 70.

Outer Peripheral Passage

The scroll compressor 10 includes outer peripheral passages R. Each outer peripheral passage R is defined by the inner peripheral surface 420 of the third peripheral wall 42 of the discharge housing member 40 and the outer peripheral surface 630 of the fixed peripheral wall 63 of the fixed scroll 60. As described above, the connecting holes 34 of the shaft support housing member 30 are located on the radially inner side of the inner peripheral surface 420 of the third peripheral wall 42 of the discharge housing member 40. Therefore, the connecting holes 34 are continuous with the respective outer peripheral passages R. Refrigerant flows into the outer peripheral passages R from the motor chamber S1 via the connecting holes 34.

Figure 3:
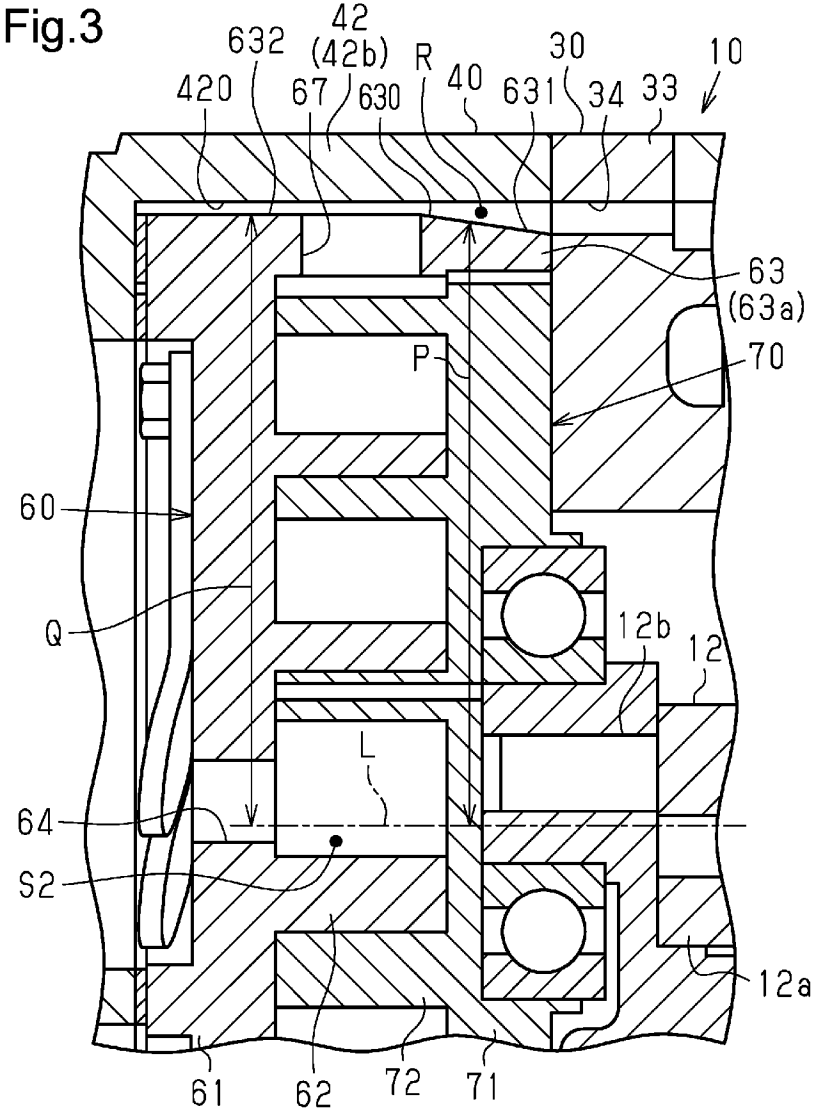
FIG. 3 is an enlarged cross-sectional view showing a part of the scroll compressor of the embodiment.

As shown in FIG. 3, an outer peripheral surface 630 of the fixed peripheral wall 63 includes an upstream-side outer peripheral surface 631 and a downstream-side outer peripheral surface 632. The upstream-side outer peripheral surface 631 is located between the suction passages 67 and the electric motor 13 in the axial direction of the rotary shaft 12. The downstream-side outer peripheral surface 632 is located adjacent to the suction passages 67 in the axial direction of the rotary shaft 12 and is located on the side opposite to the upstream-side outer peripheral surface 631.

A distance P from the axis L of the rotary shaft 12 to the upstream-side outer peripheral surface 631 in a direction orthogonal to the axial direction of the rotary shaft 12 varies in the axial direction of the rotary shaft 12. In contrast, the distance from the axis L of the rotary shaft 12 to the inner peripheral surface 420 of the third peripheral wall 42 of the discharge housing member 40 in the axial direction of the rotary shaft 12 is constant in the axial direction of the rotary shaft 12. Therefore, the distance between the inner peripheral surface 420 of the third peripheral wall 42 of the discharge housing member 40 and the outer peripheral surface 630 of the fixed peripheral wall 63 in the direction orthogonal to the axial direction of the rotary shaft 12 varies in the axial direction of the rotary shaft 12. That is, the width of each outer peripheral passage R in the radial direction of the rotary shaft 12 varies in the axial direction of the rotary shaft 12. In the present embodiment, the distance from the inner peripheral surface 420 of the third peripheral wall 42 to the outer peripheral surface 630 of the fixed peripheral wall 63 in the distal end face of the third peripheral wall 42 and the distal end face of the fixed peripheral wall 63 agrees with the diameter of the connecting hole 34.

In the present embodiment, the upstream-side outer peripheral surface 631 is inclined with respect to the axis L of the rotary shaft 12 such that the distance P, from the axis L of the rotary shaft 12 to the upstream-side outer peripheral surface 631 in the direction orthogonal to the axial direction of the rotary shaft 12, varies gradually in the axial direction of the rotary shaft 12. In the present embodiment, the distance P, from the axis L of the rotary shaft 12 to the upstream-side outer peripheral surface 631 in the direction orthogonal to the axial direction of the rotary shaft 12, increases from the motor chamber S1 toward the suction passages 67 in the axial direction of the rotary shaft 12. The thickness of the fixed peripheral wall 63 increases from the motor chamber S1 toward the suction passages 67 in the axial direction of the rotary shaft 12

Figure 4:
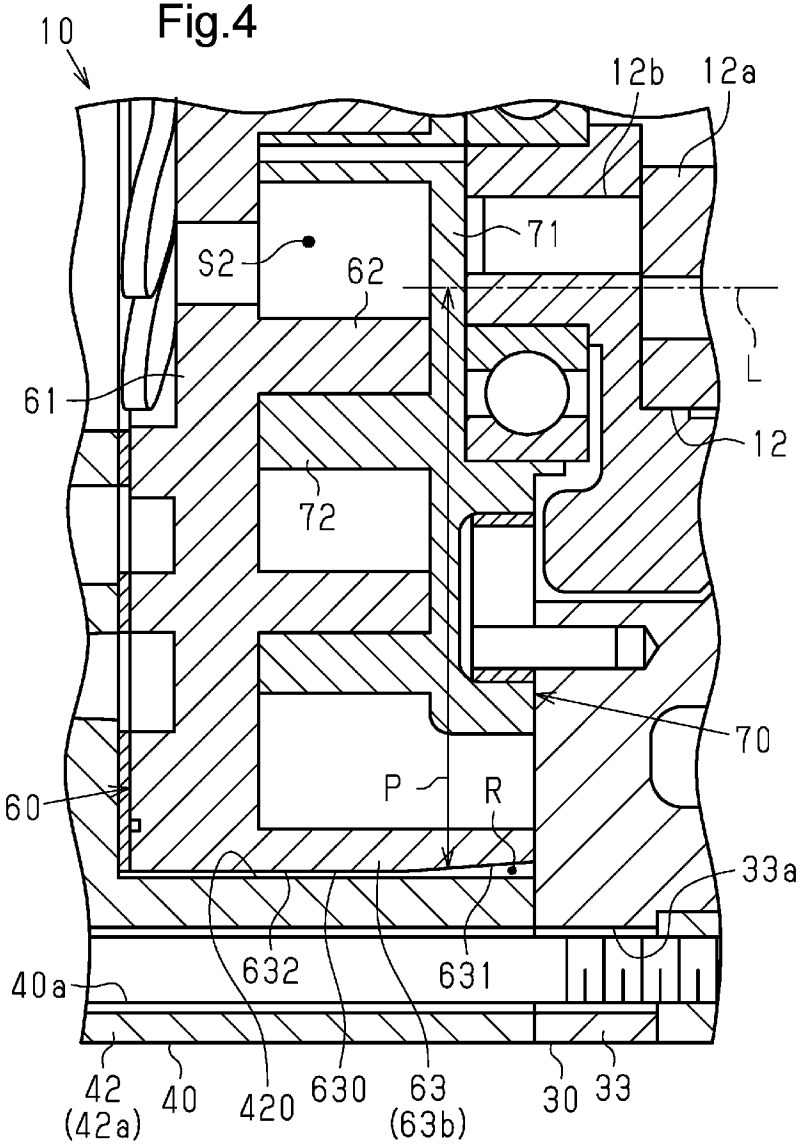
FIG. 4 is an enlarged cross-sectional view showing a part of the scroll compressor of the embodiment.

As shown in FIGS. 3 and 4, in the present embodiment, the inclination angle of the upstream-side outer peripheral surface 631 with respect to the axis L of the rotary shaft 12 varies in the circumferential direction of the fixed peripheral wall 63. Specifically, the inclination angle of the upstream-side outer peripheral surface 631 with respect to the axis L of the rotary shaft 12 is set in accordance with the positions of the suction passages 67 in the circumferential direction of the fixed peripheral wall 63 and the thickness of the fixed peripheral wall 63.

FIG. 3 shows the upstream-side outer peripheral surface 631 in one of the thick portions 63*a*. As described above, each thick portion 63*a* is a part of the fixed peripheral wall 63 that is located adjacent to one of the suction passages 67 in the circumferential direction. FIG. 4 shows the upstream-side outer peripheral surface 631 in one of the thin portions 63*b*. The inclination angle of the upstream-side outer peripheral surface 631 with respect to the axis L of the rotary shaft 12 in each thick portion 63*a* is greater than the inclination angle of the upstream-side outer peripheral surface 631 with respect to the axis L of the rotary shaft 12 in each thin portion 63*b*. That is, in the parts adjacent to each suction passage 67 in the circumferential direction of the fixed peripheral wall 63, the inclination angle of the upstream-side outer peripheral surface 631 with respect to the axis L of the rotary shaft 12 is set to be greater than that in the other portions. In contrast, in a part in the circumferential direction of the fixed peripheral wall 63 that is relatively thin, the inclination angle of the upstream-side outer peripheral surface 631 with respect to the axis L of the rotary shaft 12 is smaller than that in the other parts.

In the present embodiment, a distance Q from the axis L of the rotary shaft 12 to the downstream-side outer peripheral surface 632 in the direction orthogonal to the axial direction of the rotary shaft 12 is set to be greater than or equal to the maximum value of the distance P, from the axis L of the rotary shaft 12 to the upstream-side outer peripheral surface 631 in the direction orthogonal to the axial direction of the rotary shaft 12. The thickness of the fixed peripheral wall 63 between the suction passages 67 and the fixed end wall 61 in the axial direction of the rotary shaft 12 is greater than or equal to the thickness of the fixed peripheral wall 63 between the distal end face of the fixed peripheral wall 63 and the suction passages 67 in the axial direction of the rotary shaft 12.

Also, in the present embodiment, the distance Q, from the axis L of the rotary shaft 12 to the downstream-side outer peripheral surface 632 in the direction orthogonal to the axial direction of the rotary shaft 12, is constant in the axial direction of the rotary shaft 12. The thickness of the fixed peripheral wall 63 is constant between the suction passages 67 and the fixed end wall 61 in the axial direction of the rotary shaft 12.

Flow of Refrigerant

The flow of refrigerant in the scroll compressor 10 will now be described.

The refrigerant is drawn into the motor chamber S1 from the external refrigerant circuit through the suction port 22*a*. The refrigerant that has been drawn into the motor chamber S1 flows through the connecting holes 34 into the outer peripheral passages R. The refrigerant that has flowed into the outer peripheral passages R flows into the compression chambers S2 through the suction passages 67. Thus, the suction passages 67 draw in refrigerant from the outer peripheral passages R to the compression chambers S2. The refrigerant that has flowed into the compression chambers S2 is compressed through reduction in the volume of the compression chambers S2. The compressed refrigerant is discharged to the discharge chamber S3 through the discharge passage 64. The refrigerant that has been discharged to the discharge chamber S3 is conducted into the oil separation chamber 44 through the inflow passage 46. In the oil separation chamber 44, oil contained in the refrigerant is separated. Specifically, when the refrigerant conducted into the oil separation chamber 44 swirls around the cylindrical member 45, centrifugal force is applied to the oil contained in the refrigerant so that the oil is separated in the oil separation chamber 44. After the oil has been separated, the refrigerant passes through the interior of the cylindrical member 45 and is then returned to the external refrigerant circuit through the discharge port 47.

Operation and Advantages of Present Embodiment

An operation and advantages of the present embodiment will now be described.

(1) The distance P, from the axis L of the rotary shaft 12 to the upstream-side outer peripheral surface 631 of the fixed peripheral wall 63 in the direction orthogonal to the axial direction of the rotary shaft 12, varies in the axial direction of the rotary shaft 12. With this configuration, the part in which the distance P, from the axis L of the rotary shaft 12 to the upstream-side outer peripheral surface 631 in the direction orthogonal to the axial direction of the rotary shaft 12, is relatively small increases the distance from the inner peripheral surface 420 of the third peripheral wall 42 of the discharge housing member 40 to the outer peripheral surface 630 of the fixed peripheral wall 63. This allows the outer peripheral passages R to be enlarged without radially increasing the size of the discharge housing member 40. Further, the part in which the distance P, from the axis L of the rotary shaft 12 to the upstream-side outer peripheral surface 631 in the direction orthogonal to the axial direction of the rotary shaft 12, is relatively large ensures sufficient thickness of the fixed peripheral wall 63. This ensures the strength of the fixed scroll 60. Therefore, it is possible to widen the outer peripheral passages R while both restraining the enlargement of the housing 11 and ensuring the strength of the fixed scroll 60.

(2) The upstream-side outer peripheral surface 631 is inclined with respect to the axis L of the rotary shaft 12 such that the distance P, from the axis L of the rotary shaft 12 to the upstream-side outer peripheral surface 631 in the direction orthogonal to the axial direction of the rotary shaft 12, varies gradually in the axial direction of the rotary shaft 12. This configuration allows the refrigerant to flow smoothly through the outer peripheral passages R as compared with a case in which the upstream-side outer peripheral surface 631 has a stepwise shape such that the distance P, from the axis L of the rotary shaft 12 to the upstream-side outer peripheral surface 631 in the direction orthogonal to the axial direction of the rotary shaft 12, varies in a stepwise manner in the axial direction of the rotary shaft 12.

(3) The distance P, from the axis L of the rotary shaft 12 to the upstream-side outer peripheral surface 631 in the direction orthogonal to the axial direction of the rotary shaft 12, increases from the motor chamber S1 toward the suction passages 67 in the axial direction of the rotary shaft 12. With this configuration, the distance from the inner peripheral surface 420 of the third peripheral wall 42 of the discharge housing member 40 to the upstream-side outer peripheral surface 631 decreases from the motor chamber S1 toward the suction passages 67 in the axial direction of the rotary shaft 12. Thus, the outer peripheral passages R narrow from the motor chamber S1 toward the suction passages 67 in the axial direction of the rotary shaft 12. Therefore, the refrigerant smoothly flows through the outer peripheral passages R toward the suction passages 67, as compared with a case in which the outer peripheral passages R become wider from the motor chamber S1 toward the suction passages 67 in the axial direction of the rotary shaft 12.

(4) The inclination angle of the upstream-side outer peripheral surface 631 with respect to the axis L of the rotary shaft 12 varies in the circumferential direction of the fixed peripheral wall 63. In the present embodiment, the inclination angle of the upstream-side outer peripheral surface 631 with respect to the axis L of the rotary shaft 12 is set in accordance with the positions of the suction passages 67 in the circumferential direction of the fixed peripheral wall 63 and the thickness of the fixed peripheral wall 63. Specifically, in each thick portion 63*a*, which is a part of the fixed peripheral wall 63 adjacent to the corresponding suction passage 67 in the circumferential direction, the inclination angle of the upstream-side outer peripheral surface 631 with respect to the axis L of the rotary shaft 12 is increased to widen the outer peripheral passage R. This allows refrigerant to flow smoothly from the outer peripheral passages R to the suction passages 67. Further, in the circumferential direction, the fixed peripheral wall 63 includes the thin portions 63*b*, which are relatively thin. In each thin portion 63*b*, the strength of the fixed peripheral wall 63 is ensured by reducing the inclination angle of the upstream-side outer peripheral surface 631 with respect to the axis L of the rotary shaft 12.

(5) The distance Q, from the axis L of the rotary shaft 12 to the downstream-side outer peripheral surface 632 in the direction orthogonal to the axial direction of the rotary shaft 12, is greater than or equal to the maximum value of the distance P, from the axis L of the rotary shaft 12 to the upstream-side outer peripheral surface 631 in the direction orthogonal to the axial direction of the rotary shaft 12. This configuration increases the strength of the fixed scroll 60 as compared with a case in which the distance Q, from the axis L of the rotary shaft 12 to the downstream-side outer peripheral surface 632, is shorter than the maximum value of the distance P, from the axis L of the rotary shaft 12 to the upstream-side outer peripheral surface 631.

(6) The distance from the inner peripheral surface 420 of the third peripheral wall 42 to the outer peripheral surface 630 of the fixed peripheral wall 63 in the distal end face of the third peripheral wall 42 and the distal end face of the fixed peripheral wall 63 agrees with the diameter of the connecting hole 34. Therefore, in the distal end face of the third peripheral wall 42 and the distal end face of the fixed peripheral wall 63, refrigerant is more likely to flow into the outer peripheral passages R from the connecting holes 34 than in a case in which the distance from the inner peripheral surface 420 of the third peripheral wall 42 to the outer peripheral surface 630 of the fixed peripheral wall 63 is shorter than the diameter of the connecting holes 34.

(7) The third peripheral wall 42 of the discharge housing member 40 includes the thick portions 42*a*, which are used to form the second bolt insertion holes 40*a*. In the present embodiment, each thick portion 42*a* is a part in which the inner peripheral surface 420 of the third peripheral wall 42 bulges radially inward. The parts of the fixed peripheral wall 63 that are aligned with the thick portions 42*a* of the third peripheral wall 42 in the radial direction are the thin portions 63*b*. This configuration allows the size of the discharge housing member 40 to be reduced in the radial direction as compared with a case in which, for example, the thick portions 42*a* are provided by bulging the outer peripheral surface of the third peripheral wall 42 radially outward in order to form the second bolt insertion holes 40*a* in the third peripheral wall 42.

Modifications

The above-described embodiment may be changed as described below. The above-described embodiment and the following modifications can be combined as long as the combined modifications remain technically consistent with each other.

The configuration of the housing 11 of the above-described embodiment is merely an example. The structure of the housing 11 may be changed.

For example, in place of the discharge housing member 40, the shaft support housing member 30 may include the third peripheral wall 42. In this case, the third peripheral wall 42 extends from the outer periphery of the flange 33 in a direction away from the motor housing member 20. The discharge housing member 40 includes only the third bottom wall 41. The third bottom wall 41 is coupled to the distal end of the third peripheral wall 42, so as to close the opening of the shaft support housing member 30.

For example, in place of the discharge housing member 40, the motor housing member 20 may include the third peripheral wall 42. In this case, the third peripheral wall 42 is formed by extending the first peripheral wall 22 in the axial direction. The discharge housing member 40 includes only the third bottom wall 41. The third bottom wall 41 is coupled to the distal end of the third peripheral wall 42 so as to close the opening of the motor housing member 20. The shaft support housing member 30 is disposed in the motor housing member 20. The shaft support housing member 30 separates the motor chamber S1 from the space that accommodates the compression mechanism 14.

The upstream-side outer peripheral surface 631 does not necessarily need to be inclined with respect to the axis L of the rotary shaft 12 if the distance P, from the axis L of the rotary shaft 12 to the upstream-side outer peripheral surface 631 of the fixed peripheral wall 63 in the direction orthogonal to the axial direction of the rotary shaft 12, varies in the axial direction of the rotary shaft 12. For example, the upstream-side outer peripheral surface 631 may have a stepwise shape such that the distance P, from the axis L of the rotary shaft 12 to the upstream-side outer peripheral surface 631 in the direction orthogonal to the axial direction of the rotary shaft 12, varies in a stepwise manner in the axial direction of the rotary shaft 12.

The distance P, from the axis L of the rotary shaft 12 to the upstream-side outer peripheral surface 631 in the direction orthogonal to the axial direction of the rotary shaft 12, does not necessarily need to increase from the motor chamber S1 toward the suction passages 67 in the axial direction of the rotary shaft 12 if the distance P varies in the axial direction of the rotary shaft 12. For example, the distance P, from the axis L of the rotary shaft 12 to the upstream-side outer peripheral surface 631 in the direction orthogonal to the axial direction of the rotary shaft 12, may decreases from the motor chamber S1 toward the suction passages 67 in the axial direction of the rotary shaft 12.

The inclination angle of the upstream-side outer peripheral surface 631 with respect to the axis L of the rotary shaft 12 may be constant in the circumferential direction of the fixed peripheral wall 63.

The distance from the inner peripheral surface 420 of the third peripheral wall 42 to the outer peripheral surface 630 of the fixed peripheral wall 63 in the distal end face of the third peripheral wall 42 and the distal end face of the fixed peripheral wall 63 may be different from the diameter of the connecting hole 34.

The distance Q, from the axis L of the rotary shaft 12 to the downstream-side outer peripheral surface 632 in the direction orthogonal to the axial direction of the rotary shaft 12, may be smaller than the maximum value of the distance P, from the axis L of the rotary shaft 12 to the upstream-side outer peripheral surface 631 in the direction orthogonal to the axial direction of the rotary shaft 12.

The distance Q, from the axis L of the rotary shaft 12 to the downstream-side outer peripheral surface 632 in the direction orthogonal to the axial direction of the rotary shaft 12, may vary in the axial direction of the rotary shaft 12.

The application of the scroll compressor 10 is not limited to vehicle air conditioners. For example, the scroll compressor 10 may be mounted on a fuel cell electric vehicle. The scroll compressor 10 may compress air that is fluid supplied to a fuel cell.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A scroll compressor, comprising:

a rotary shaft;

an electric motor that rotates the rotary shaft;

a housing including a motor chamber that accommodates the electric motor;

a fixed scroll accommodated in the housing and fixed to the housing; and an orbiting scroll that orbits as the rotary shaft rotates, wherein the fixed scroll includes:

a fixed end wall; and a tubular peripheral wall that extends from the fixed end wall toward the orbiting scroll, the scroll compressor further comprises:

a compression chamber defined by the fixed scroll and the orbiting scroll, the compression chamber compressing fluid;

an outer peripheral passage that is defined by an inner peripheral surface of the housing and an outer peripheral surface of the peripheral wall, fluid flowing into the outer peripheral passage from the motor chamber; and a suction passage provided in the peripheral wall, the suction passage drawing in the fluid from the outer peripheral passage to the compression chamber, the outer peripheral surface of the peripheral wall includes an upstream-side outer peripheral surface located between the suction passage and the electric motor in an axial direction of the rotary shaft, a distance from an axis of the rotary shaft to the upstream-side outer peripheral surface in a direction orthogonal to the axial direction of the rotary shaft varies in the axial direction of the rotary shaft, the upstream-side outer peripheral surface is inclined with respect to the axis of the rotary shaft such that the distance from the axis of the rotary shaft to the upstream-side outer peripheral surface in the direction orthogonal to the axial direction of the rotary shaft gradually increases from the motor chamber toward the suction passage in the axial direction of the rotary shaft, and an inclination angle of the upstream-side outer peripheral surface with respect to the axis of the rotary shaft varies in a circumferential direction of the peripheral wall.

2. The scroll compressor according to claim 1, wherein the upstream-side outer peripheral surface is inclined with respect to the axis of the rotary shaft such that the distance from the axis of the rotary shaft to the upstream-side outer peripheral surface in the direction orthogonal to the axial direction of the rotary shaft varies gradually in the axial direction of the rotary shaft.

3. The scroll compressor according to claim 1, wherein the outer peripheral surface of the peripheral wall includes a downstream-side outer peripheral surface that is located adjacent to the suction passage in the axial direction of the rotary shaft and is located on a side opposite to the upstream-side outer peripheral surface, and a distance from the axis of the rotary shaft to the downstream-side outer peripheral surface in the direction orthogonal to the axial direction of the rotary shaft is greater than or equal to a maximum distance from the axis of the rotary shaft to the upstream-side outer peripheral surface.

4. The scroll compressor according to claim 3, wherein the distance from the axis of the rotary shaft to the downstream-side outer peripheral surface in the direction orthogonal to the axial direction of the rotary shaft is constant in the axial direction of the rotary shaft.

5. A scroll compressor, comprising:

a rotary shaft;

an electric motor that rotates the rotary shaft;

a housing including a motor chamber that accommodates the electric motor;

a fixed scroll accommodated in the housing and fixed to the housing; and an orbiting scroll that orbits as the rotary shaft rotates, wherein the fixed scroll includes:

a fixed end wall; and a tubular peripheral wall that extends from the fixed end wall toward the orbiting scroll, the scroll compressor further comprises:

a compression chamber defined by the fixed scroll and the orbiting scroll, the compression chamber compressing fluid;

an outer peripheral passage that is defined by an inner peripheral surface of the housing and an outer peripheral surface of the peripheral wall, fluid flowing into the outer peripheral passage from the motor chamber; and a suction passage provided in the peripheral wall, the suction passage drawing in the fluid from the outer peripheral passage to the compression chamber, the outer peripheral surface of the peripheral wall includes an upstream-side outer peripheral surface located between the suction passage and the electric motor in an axial direction of the rotary shaft, a distance from an axis of the rotary shaft to the upstream-side outer peripheral surface in a direction orthogonal to the axial direction of the rotary shaft varies in the axial direction of the rotary shaft, the peripheral wall includes a peripheral wall end face of the peripheral wall that is on a side opposite to the fixed end wall, and the suction passage is arranged at a position away from both the fixed end wall and the peripheral wall end face.

* * * * *